US008307570B2

(12) United States Patent
Delgatty

(10) Patent No.: US 8,307,570 B2
(45) Date of Patent: Nov. 13, 2012

(54) ATTACHMENT SYSTEM FOR SHOE UPPERS

(75) Inventor: Grant Delgatty, Pasadena, CA (US)

(73) Assignee: Urshuz Inc., Saint Hubert, Quebec (CA)

( * ) Notice: Subject to any disclaimer, the term of this patent is extended or adjusted under 35 U.S.C. 154(b) by 475 days.

(21) Appl. No.: 12/531,679

(22) PCT Filed: Mar. 14, 2008

(86) PCT No.: PCT/US2008/057118

§ 371 (c)(1),
(2), (4) Date: Sep. 16, 2009

(87) PCT Pub. No.: WO2008/115824

PCT Pub. Date: Sep. 25, 2008

(65) Prior Publication Data

US 2010/0024251 A1 Feb. 4, 2010

Related U.S. Application Data

(60) Provisional application No. 60/895,372, filed on Mar. 16, 2007.

(51) Int. Cl.
*A43B 3/24* (2006.01)
*A43B 3/12* (2006.01)
*A43C 13/00* (2006.01)

(52) U.S. Cl. ..... 36/100; 36/101; 36/11.5; 36/15

(58) Field of Classification Search ..... 36/22 R, 36/100, 101, 102, 103, 3 R, 3 A, 3 B, 11.5, 36/12, 15, 23

See application file for complete search history.

(56) References Cited

U.S. PATENT DOCUMENTS

| | | | | |
|---|---|---|---|---|
| 2,435,668 | A * | 2/1948 | Behringer et al. | 36/11.5 |
| 3,983,642 | A | 10/1976 | Liao | |
| 4,103,440 | A | 8/1978 | Lawrence | |
| 4,267,649 | A | 5/1981 | Smith | |
| 4,297,798 | A * | 11/1981 | Colan | 36/101 |
| 4,377,042 | A | 3/1983 | Bauer | |
| 4,450,633 | A * | 5/1984 | Connelly | 36/101 |

(Continued)

FOREIGN PATENT DOCUMENTS

KR 10-2004-00920 11/2004

OTHER PUBLICATIONS

PCT/US2008/07118, International Filing Date: Mar. 14, 2008; Publication No. WO2008/115824, Published Sep. 25, 2008; International Search Report with Written Opinion dated Jul. 29, 2008.

*Primary Examiner* — Khoa Huynh
*Assistant Examiner* — Melissa Lalli
(74) *Attorney, Agent, or Firm* — Michael Fedrick; Loza & Loza, LLP

(57) ABSTRACT

A system for attaching a shoe upper to a shoe bottom through the use of elastic loops attached to the perimeter edge of the upper, the elastic loops being fitted to corresponding channels molded into the sidewall and lower surface of the shoe bottom. Easy attachment and removal of the shoe upper allows for replacement of the shoe upper with an alternative upper of a different color, pattern, or structure.

14 Claims, 5 Drawing Sheets

U.S. PATENT DOCUMENTS 4,706,392 A 11/1987 Yang
4,733,439 A 3/1988 Gentry
4,887,369 A 12/1989 Bailey
4,974,344 A 12/1990 Ching
5,065,531 A 11/1991 Prestridge
5,083,385 A 1/1992 Halford
5,310,047 A 5/1994 Ledingham
5,381,610 A 1/1995 Hanson
5,544,430 A 8/1996 Jacko
5,737,853 A 4/1998 Smejkal
5,778,564 A 7/1998 Kettner
5,802,738 A * 9/1998 Ferniani ..... 36/11.5
5,822,888 A 10/1998 Terry
5,852,885 A 12/1998 Ferniani
5,983,528 A 11/1999 Hartung
5,991,950 A 11/1999 Schenkel
6,345,454 B1 2/2002 Cotton
6,640,464 B2 11/2003 Hsin
6,874,256 B2 4/2005 Delgatty
6,931,766 B2 8/2005 Greene
7,117,615 B2 10/2006 Gerber
2006/0242861 A1 11/2006 Dushey
2006/0248753 A1 11/2006 Welsh

* cited by examiner

Fig. 4a
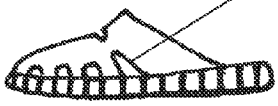
Fig. 4b
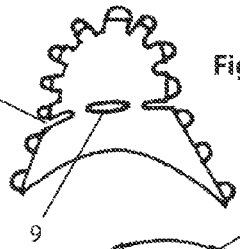
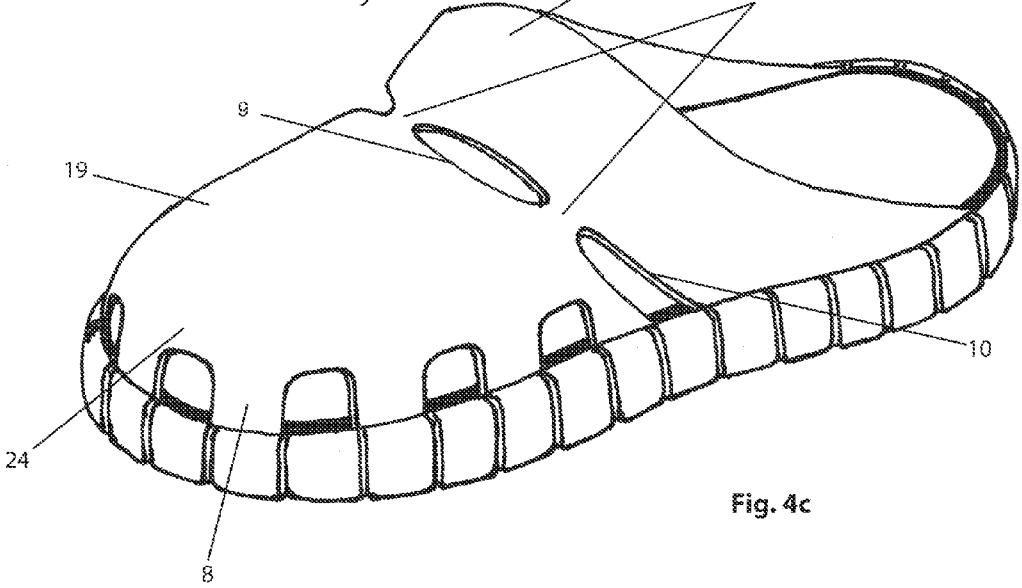
Fig. 4c

Fig. 5
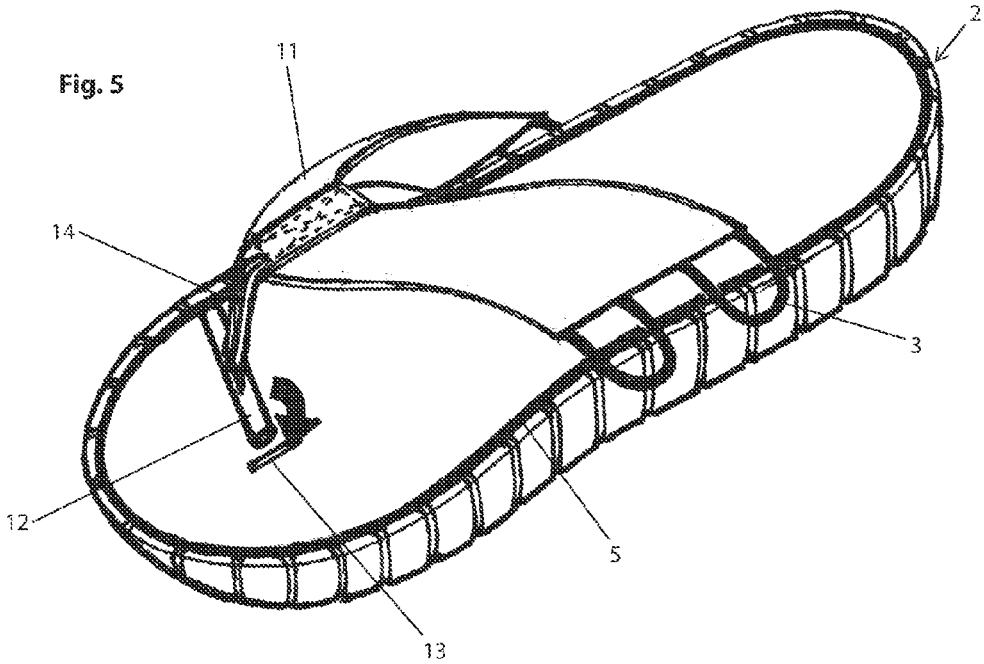
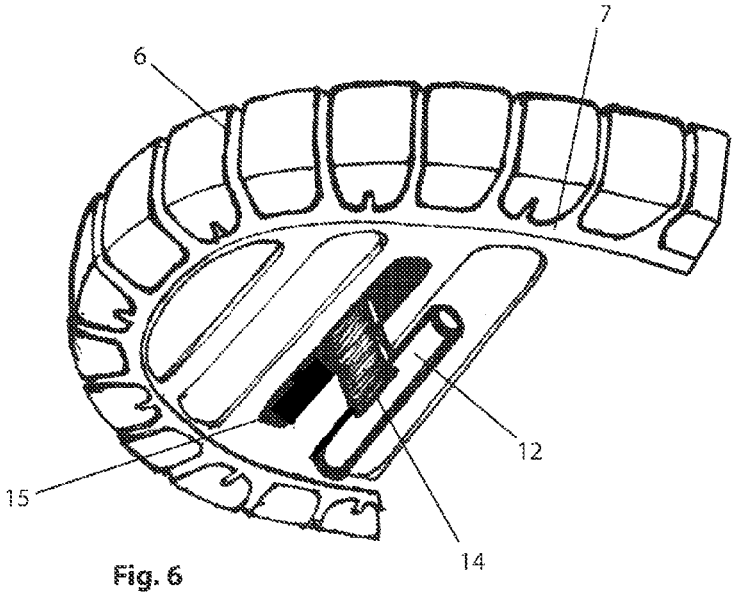
Fig. 6

ATTACHMENT SYSTEM FOR SHOE UPPERS

The present application claims the benefit of priority from U.S. Patent Application No. 60/895,372, filed on Mar. 16, 2007 and titled "Attachment System for Shoe Uppers," the content of which is hereby incorporated by reference in its entirety.

BACKGROUND

Conventional articles of footwear generally comprise an upper portion permanently attached to a sole. Certain footwear designs have been proposed, however, in which the upper and sole portions are detachable. U.S. Pat. No. 6,931,766, for example, discloses an article of footwear having a foot-receiving portion which includes releasable fasteners that engage corresponding attachment elements located on a side of the sole portion of the article. U.S. Pat. No. 6,874,256 discloses an alternative shoe construction which includes a removable vamp attached to a sole portion with a zipper fastener.

SUMMARY

The present article of footwear comprises a removable shoe upper, a shoe bottom having a sidewall, and elastic fasteners for attaching the shoe upper to the shoe bottom. The shoe bottom preferably includes a recessed channel running around the perimeter of the upper surface of the shoe bottom which allows the perimeter edge of the shoe upper to be inserted into it. The shoe bottom includes sidewall channels in at least one sidewall of the shoe bottom which extend to the lower surface of the shoe bottom, as well as a plurality of lugs on the lower surface of the shoe bottom, each lug having a rear surface positioned inwardly with respect to the rear surfaces of sidewall channels. Preferably, the lugs form a tread pattern in the lower surface of the shoe bottom. The sidewall channels also preferably extend inwardly from the sidewall along the lower surface of the shoe bottom and converge at a junction adjacent the rear surface of a lug.

Each of the elastic loop fasteners is attached to the perimeter edge of the shoe upper in a spaced-apart manner for placement into at least one sidewall channel in the sidewall of the shoe bottom, such that each of the loop fasteners can be threaded through at least one corresponding sidewall channel and engage the rear surface of one of the lugs, thereby resulting in a tensioned engagement of the sidewall channels and lugs by the loop fasteners. Preferably, each elastic loop is placed into two different sidewall channels. The sidewall channels are also preferably deeper than the diameter of the elastic loop fasteners so that the outer surfaces of the elastic loop fasteners do not protrude beyond the surface of the sidewall channels when placed in the sidewall channels. This protects the elastic loop fasteners from abrasion during use.

In a preferred embodiment, the shoe upper comprises a flat sheet of flexible material. Such a sheet of material can have an image transferred onto it, in order to personalize the present articles of footwear. In this embodiment, the shoe upper preferably comprises two slits in both the medial and lateral sides of the shoe upper as well as an elongated opening positioned between the two slits, in order for the front portion of the shoe upper to form a curve corresponding to the instep of a user when attached to the shoe bottom of the present article of footwear. The front portion of the shoe upper in this embodiment can further comprise multiple, spaced-apart tabs.

In another embodiment, the shoe bottom can comprise an insole and an outsole, with sidewall channels being formed in the outsole. Preferably, the outsole comprises a cavity for retaining the insole, in which case the outsole can further comprise a lip for mechanically retaining the insole in the cavity. In a further embodiment, the shoe upper can comprise a three point sandal strap having a toe-post, in which case the shoe bottom comprises a hole extending from the upper surface of the shoe bottom to the lower surface of the shoe bottom to allow the sandal post to pass through the shoe bottom.

Methods of attaching a shoe upper to a shoe bottom with the present attachment system are also disclosed. These and other features, aspects and advantages of the present invention will become better understood with regard to the following description, appended claims, and accompanying figures.

DRAWINGS

Figure 1:
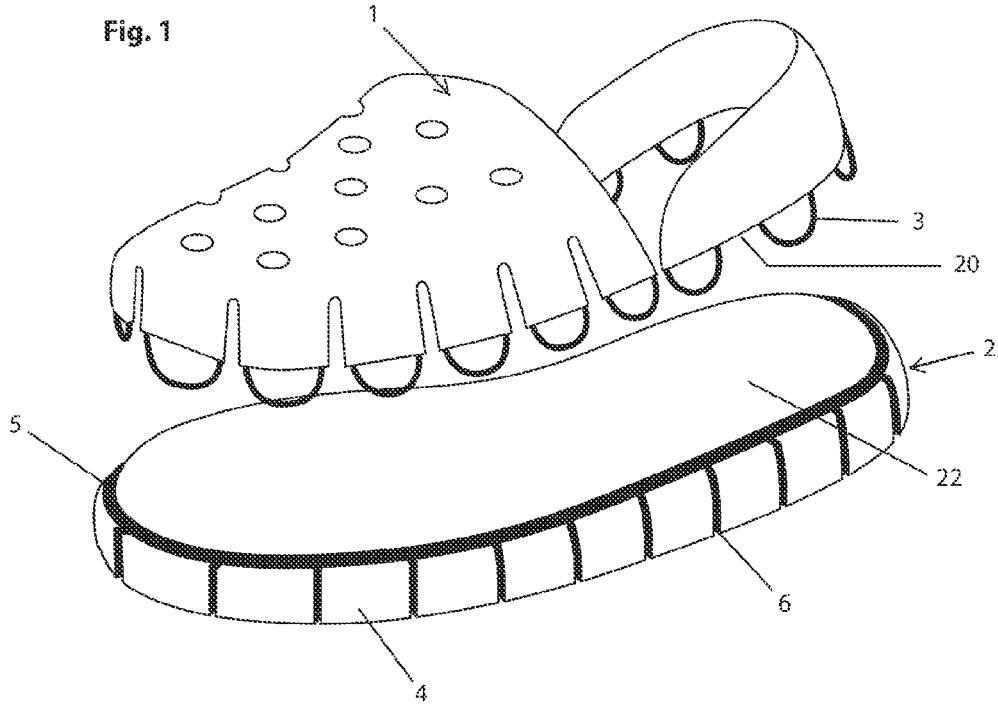
FIG. 1 is an exploded perspective view of an article of footwear comprising the present attachment system.
Figure 3A:
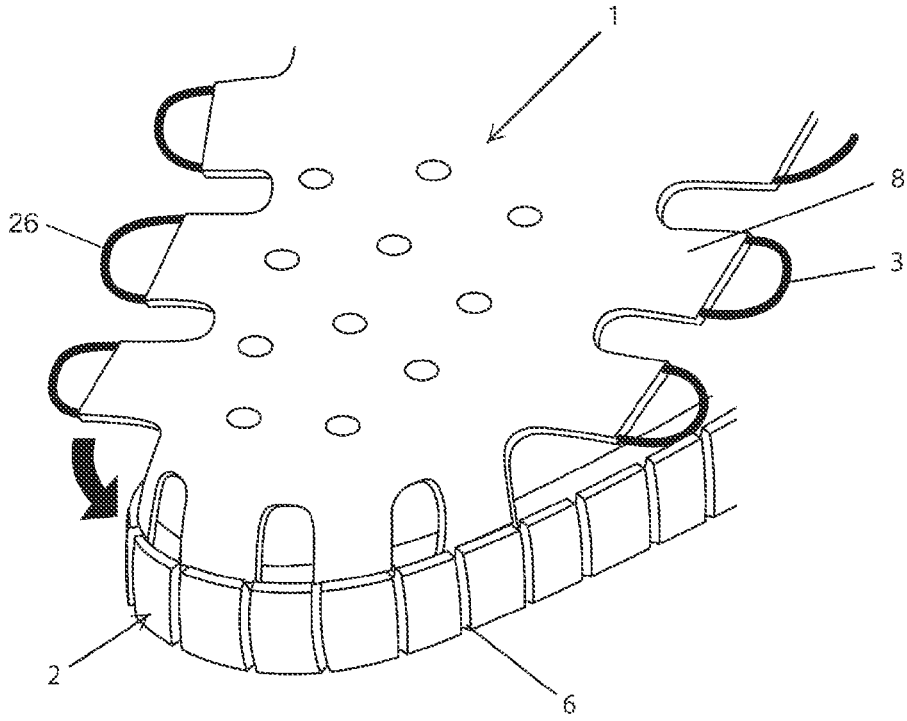

FIG. 3*a* is a partial perspective view of the upper surface of the toe portion of the article of footwear of FIG. 1, showing the upper and bottom portions of the article partially attached.

Figure 3B:
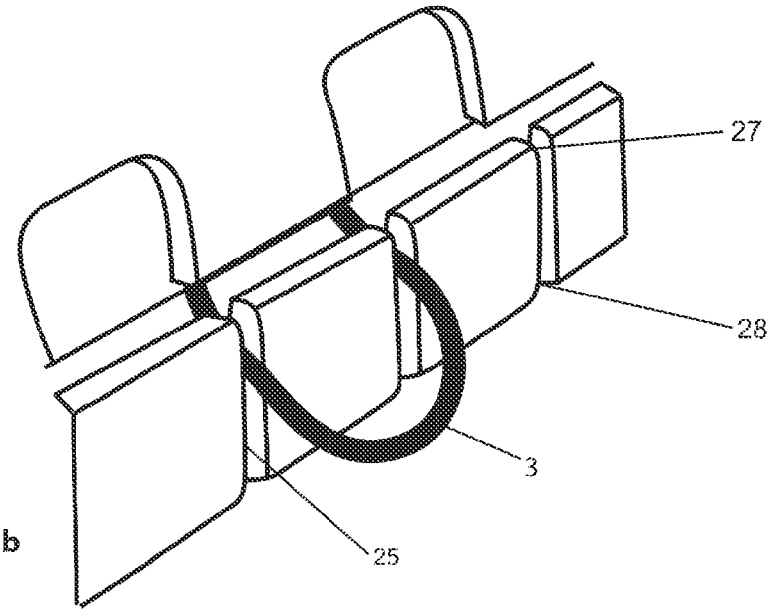

FIG. 3*b* is a partial perspective view of the side of the article of footwear of FIG. 1, showing the upper and bottom portions of the article partially attached.

FIG. 4*a* is a side view of an alternative embodiment of an article of footwear comprising the present attachment system.

FIG. 4*b* is a plan view of the upper portion of the article shown in FIG. 4*a*.

FIG. 4*c* is a perspective view of the article of footwear shown in FIGS. 4*a* and 4*b*.

FIG. 5 is an exploded perspective view of a sandal comprising an embodiment of the present attachment system.

FIG. 6 is a partial perspective view of the lower surface of the toe portion of the sandal of FIG. 5 showing the placement of the toe-post.

Figure 7:
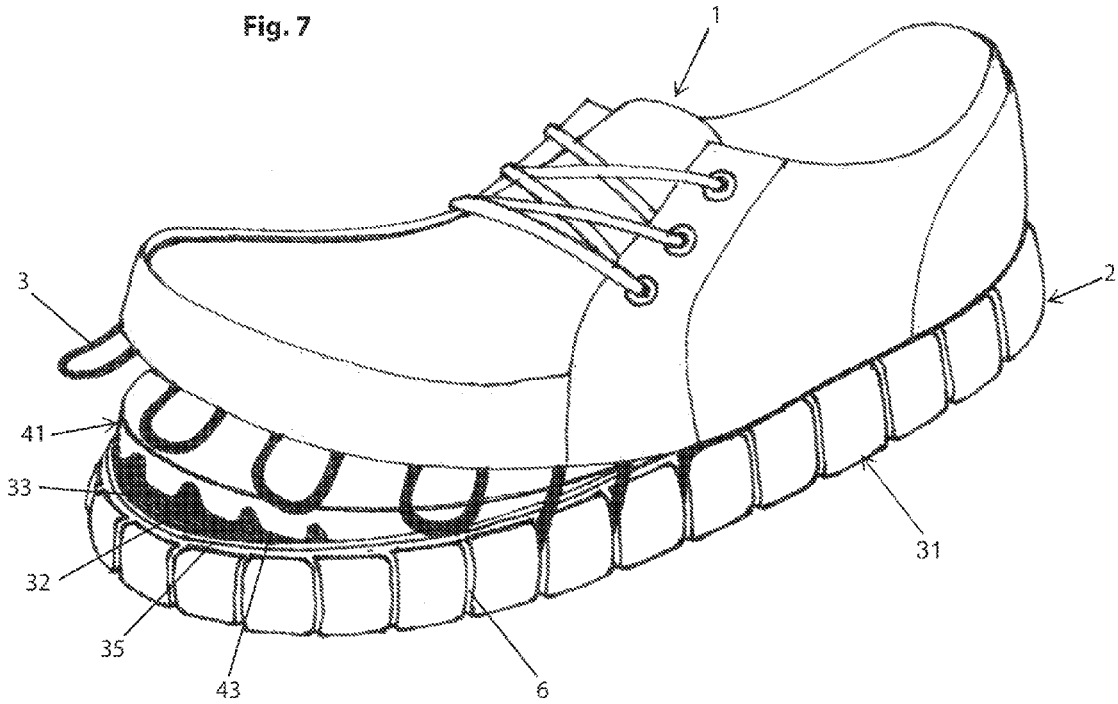

FIG. 7 is a perspective view of an alternative embodiment of an article of footwear comprising the present attachment system, showing the upper portion of the article of footwear separated from a separate insole and bottom portion.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by their intended use.

DESCRIPTION

There remains a need for improved systems for removably attaching a shoe upper to a shoe bottom. The ability to easily attach and remove a shoe upper 1 to a shoe bottom 2 using the present attachment system is accomplished through the use of a connection made between a series of elastic loop fasteners 3 attached to the perimeter edge 20 of the shoe upper 1, and corresponding channels 6 molded into the sidewall 4 and (in some embodiments) into the lower surface 17 of the shoe bottom 2. The shoe upper 1 preferably does not include a portion extending underneath the foot of a wearer and comprises only a cover layer which extends over the instep of a wearer's foot.

The shoe bottom 2 preferably has a recessed channel 5 located around the perimeter of the upper surface 22 of the shoe bottom 2 adjacent sidewall 4. The recessed channel 5 is sized to allow the perimeter edge 20 of the upper 1 to be inserted into it, thus giving the upper 1 a defined and consistent positioning in relation to the shoe bottom 2 when attached to the shoe bottom 2. This channel 5 also allows for the upper 1 to maintain its position on the shoe bottom 2 when exposed to any lateral forces exerted on the upper 1, such as during walking when the shoe is being worn by an individual.

Figure 2:
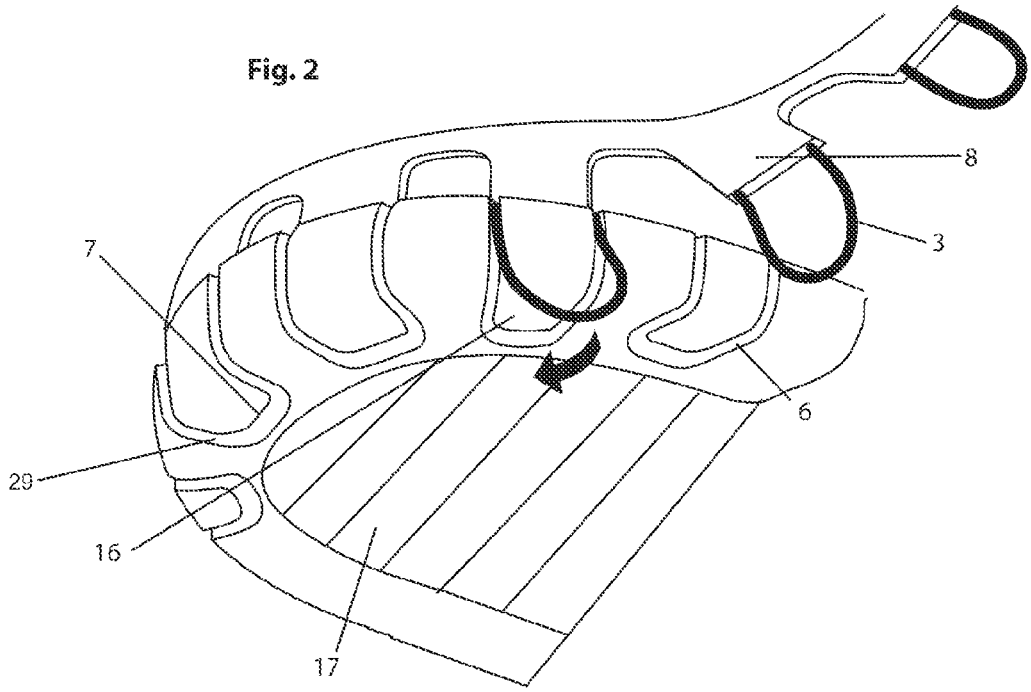
FIG. 2 is a partial perspective view of the lower surface of the toe portion of the article of footwear of FIG. 1, showing the upper and bottom portions of the article partially attached.

Once the shoe upper 1 has been positioned onto the shoe bottom 2, the upper 1 is then anchored to the shoe bottom 2 by threading a plurality of elastic loops 3 through corresponding sidewall channels 6 in the sidewall 4, as shown in FIGS. 2-3*b*. The loops comprise a string or cord made of any suitably elastic material, such as a natural or synthetic rubber, for example neoprene. Each end of an elastic loop 3 extends from the perimeter edge 20 of the shoe upper 1, preferably in a spaced-apart fashion for placement into two different, correspondingly spaced-apart sidewall channels 6 in the sidewall 4 of the shoe bottom 2. The perimeter edge 20 of the shoe upper 1 thus joins the two ends of each piece of elastic material to form an elastic loop fastener 3. In some contemplated embodiments, the loop ends can be adjacent to each other along the perimeter edge 20 of the shoe upper 1 and can be inserted into a single sidewall channel 6.

In some embodiments, as illustrated in FIGS. 2 and 6, the two channels 6 in the sidewall 4 continue into lower surface channels 29 in the lower surface 17 of the shoe bottom 2, which extend inwardly from the sidewall 4 along the lower surface 17 and meet at a junction, thereby forming a single continuous channel in the material that forms the shoe bottom 2. The sidewall channels 6 and lower surface channels 29 are sized to accommodate the elastic loops 3, preferably such that the outer surface of each of such loops does not protrude or extend beyond the surface of the sidewall 4 and/or the lower surface 17 when placed in a sidewall channels 6 and/or a lower surface channel 29, with such channels preferably being deeper than the diameter of the elastic loops 3. The sidewall channels 6 preferably extend from an upper edge 27 of the shoe bottom 2, i.e. at or adjacent to where the channel 6 meets the upper surface 22 of the shoe bottom 2, to a lower edge 28 where the channel 6 meets the lower surface 17 of the shoe bottom 2. However, in some embodiments the sidewall channel 6 need not extend to the upper edge 27. Sidewall channels 6 and/or lower surface channels should, however, at least exist at the lower edge 28 of the shoe bottom 2 to ensure that the outer surfaces of the elastic loop fasteners 3 are at least flush with the lower surface 17 of the shoe bottom 2, to prevent excessive wear of the elastic loop fasteners 3.

As further shown in FIGS. 2 and 6, the lower surface 17 of the shoe bottom 2 includes lugs, i.e. protrusions or projections from the lower surface 17 which can provide support for the elastic loops 3, and which can in some embodiments form a tread pattern in the lower surface 17 of the shoe bottom 2, i.e., a series of regular or irregular protrusions and indentations or grooves. In this embodiment, the elastic loops 3 are preferably held in place by wrapping the elastic loops 3 around corresponding lug (tread) shapes 16 on the lower surface 17 of the shoe bottom 2. The elastic loops 3 engage a rear surface or face 7 of the lug 16 which is positioned inwardly with respect to the rear surfaces 25 of the side channels 6. That is, the rear surfaces 7 of some or all of the lugs 16 are positioned closer to the center of the lower surface 17 of the shoe bottom 2 than the rear surfaces 25 of the sidewall channels 6. For sidewall channels 6 located on either lateral side of the article of footwear, the rear surfaces 7 of the lugs 16 are therefore closer to the midline of the article of footwear than the rear surfaces 25 of the channels 6. This leads to a tensioned engagement of the side channels and lug by the elastic loops 3.

The lugs 16 preferably protrude outwardly (i.e., away from and generally downwardly) from the lower surface 17 of the shoe bottom 2 by a distance at least equal to the diameter of the elastic loops 3, and preferably greater than the diameter of the loops 3, so that the loops 3 are protected from wear while retained on the lug. A groove can be included in the portion of the lug 16 which retains an elastic loop 3 in order to better secure the elastic loop 3 to the lug 16.

To engage the elastic loop fasteners 3 with sidewall channels 6 and lugs 16 of the shoe bottom 2, an individual preferably first positions the shoe upper 1 on top of the shoe bottom 2 such that each loop is vertically aligned (with respect to a support surface on which the shoe bottom 2 rests) with a respective sidewall channel or channels 6. In the embodiments shown in FIGS. 1-7, the sidewall channels 6 are arranged in the shoe bottom 2 such that each of the channels 6 is generally aligned with one end of an elastic loop fastener 3, i.e. with the junction between the elastic loop fastener 3 and the perimeter edge 20 of the shoe upper 1.

Once the shoe upper 1 is positioned on the shoe bottom 2 in this way, a user can grasp the elastic loop fastener 3 and guide it so that the portion of the elastic loop 3 extending from the perimeter edge 20 fits into the respective sidewall channels 6. The middle portion 26 of the elastic loop 3, i.e. the portion adjacent the point midway between the junctions between the elastic loop fastener 3 and the perimeter edge 20 of the shoe upper 1, is then grasped by the individual and pulled downward past the lower vertical extent of the sidewall channels 6. Still grasping the elastic loop fastener 3, the individual then pulls the middle portion 26 of the elastic loop fastener 3 past the rear surface 7 of a lug 16 positioned inwardly with respect to the sidewall channels 6. The foregoing pulling step, and/or the step of pulling the elastic loop fastener 3 downward past the lower vertical extent of the sidewall channels 6, stretches the elastic material comprising the elastic loop fastener, with such stretching being understood to be within the elastic limit of the elastic material.

In order to complete the attachment of the elastic loop fastener 3 to the lug 16, the middle portion 26 of the elastic loop fastener 3 is moved upwardly, i.e. toward the lower surface 17 of the shoe bottom 2, so that when the elastic loop fastener 3 is released from the individuals grasp, it will shorten (contract) and contact the rear surface 7 of the lug 16. The elastic force of the elastic loop fastener 3 against the rear surface 7 of the lug 16, as well as friction between the elastic loop fastener and the surface of the shoe bottom 2 with which it is in contact, operate to retain the elastic loop fastener on the shoe bottom and to attach the shoe upper 1 to the shoe bottom 2. To remove the upper 1 from the bottom 2, the wearer would simply reverse the foregoing attachment process.

In alternative embodiments, the elastic loops 3 can be attached to the shoe bottom 2 using other mechanical fasteners, such as snap or button-type fasteners. In a further alternative, one end of the elastic loop 3 can be attached to the perimeter edge 20 on the medial side of the upper 1, with the other end of the loop being attached to the perimeter edge 20 on the opposite, lateral side of the upper 1. In this embodiment, the lower surface channel 29 on the lower surface 17 of the shoe bottom 2 extends from one lateral side of the shoe bottom 2 to the other lateral side. In this way the elastic loop 3 can be positioned in the channel by placing the shoe bottom 2 through the elastic loop 3 and positioning the shoe upper 1 on the upper surface 22 of the shoe bottom 2.

In a preferred embodiment, shown in FIG. 4*b*, the upper is created from a single, flat sheet of flexible material which is either die-cut or molded into a pattern shape that, when attached to the shoe bottom, takes on an ergonomic profile consistent with the natural curvature of the foot, as seen in FIG. 4*a*, i.e. such that it follows the upward curvature (with respect to the shoe bottom 2) of the instep of the foot. The key element allowing this to happen is the use of two long, narrow openings or slits 10 formed or cut into both the medial and lateral sides of the upper 1, along with a corresponding elongated opening or hole 9 positioned between the two slits. The attached area 18 between the slits 10 and the lateral ends of the center hole shape 9 serve as pivot points, and allow a rearward area 23 of the upper 1 to curve at a different angle than a frontward area 24, thus allowing the upper 1 to take on a profile more natural to the foot shape. The positioning of these slits 10 would correspond to the instep of the foot.

The toe-box 19 area of the upper 1, i.e. the front portion of the article of footwear generally occupied by the toes of a wearer, also has the ability to take on a natural, three dimensional form of the shoe due to pattern features either molded or die-cut into the flat panel. This toe-box shape is created through the use of multiple, spaced-apart extensions of material, shown in FIGS. 1-4*c* as generally teeth or tab shapes 8, that when bent into position allow for the wall of the upper 1 to contour its way around the perimeter of the shoe bottom 2 (FIG. 4).

When a shoe upper 1 in the present article of footwear is formed from a flat sheet of flexible material as described above, it is possible to print a pattern or photograph onto the upper 1, either during the manufacturing of the article or after distribution to a consumer. In order to accomplish this, the shoe upper 1 is detached from or otherwise provided separately from the shoe bottom 2 and laid in a flat orientation (as seen in FIG. 4*b*). At the consumer level, the wearer would have the ability to print out an image from a standard ink jet printer onto a special transfer paper, and then transfer the image onto the shoe upper 1 via heat or a gluing process. Other printing processes such as screen printing and sublimation printing (i.e., iron-on transfer) can also be used. These printing processes can typically only be executed on a flat surface.

Another feature of the present attachment system is the ability to remove the shoe upper 1 and replace it with a different upper, for example a standard three point sandal strap 11 (sometimes referred to as a flip-flop). In order to achieve this, a hole 13 penetrating from the upper surface 22 to the lower surface 17 of the shoe bottom 2 would be positioned to correspond to the placement of a typical sandal toe-post 14. At the exit point of the hole 13 on the lower surface 17 (FIG. 6), a corresponding, recessed cavity or channel 15 is provided. The purpose of this hole and channel is to allow for an elongated, rigid member 12, preferably a cylinder, to be fed through the hole with an attached toe-post 14 material (i.e.—nylon webbing), rotated 90 degrees, and inserted into the channel 15. The opposite end of the toe-post material would be stitched to a sandal strap 11. This strap would have the same elastic loop system as in the previously described shoe application, attached to the outer edges of the strap. By utilizing both the elastic loops 3 on the medial and lateral sides of the strap 11, and the toe-post anchoring system as described above, this strap 11 has the same ability to be easily attached and removed, as well as being reversible.

In an alternative embodiment, shown in FIG. 7, the bottom portion 2 of the present article of footwear can be formed from two different pieces of material, namely an outsole 31, i.e. the outer sole of an article of footwear including the bottom of the shoe that makes contact with the ground, and an insole 41, i.e. the inner sole of a shoe or boot which contacts the foot of a wearer. Different materials can in this way be used to provide the insole 41 and outsole 31 with different properties. For example, a more durable material, such as synthetic rubber, can be used to form the outsole 31 while a softer, more comfortable material such as EVA can be used to form the insole 41. In this embodiment, the present attachment system can be used to attach the upper unit 1 to the outsole 31 by inserting loops 3 in the upper 1 into sidewall channels 6 and then extending such loops in order to place them into contact with the rear surfaces 7 of the respective lugs 16 located on the lower side 17 of the outsole 31.

In the embodiment of FIG. 7, the insole 41 fits within a cavity or other open space 32 located on the upper surface 33 of the outsole 31. The outsole 31 preferably further includes a lip 35 in the upper portion of the outsole 31 which mechanically retains the insole 41 in the cavity 32, although other attachment means, such as a different mechanical attachment system or the use of an adhesive to bond the bottom surface 43 of the insole 41 to the upper surface 33 of the outsole 31, can also be used. The outsole 31 and insole 41 are, however, preferably not bonded to each other with adhesive, in order to reduce the use of adhesives in manufacturing and reduce the environmental impact of manufacturing an article of footwear having the present attachment system.

In a further alternative embodiment, the insole 41 can comprise channels for retaining the elastic loops 3 of the upper 1, and the outsole 31 can be configured to receive the insole 41 so that the channels 6 in the outsole 31 line up with corresponding channels in the insole. In this way, the insole can be retained more securely to the shoe. This embodiment would also be appropriate for shoe designs in which the outsole 31 doesn't include a lip 35. The foregoing embodiments can also further comprise a midsole between the insole and the outsole.

The shoe upper 1 and shoe bottom 2 are preferably both formed from an injection-molded plastic material, such as Croslite™ PCCR (patented closed cell resin), but can be formed from other materials. The upper 1 can be molded to fit on the instep of a foot or otherwise have such a shape imparted to it, but can alternatively comprise a flat sheet of a flexible material such as canvas, leather, or polyurethane (molded or die-cut), as described above. The shoe bottom 2 can be molded as a unitary structure formed from a durable material such as synthetic rubber, ethylvinylacetate (EVA), an ethylvinylacetate-rubber blend, or polyurethane foam, or can further include an insole portion 41 formed from a material providing greater cushioning or other desirable properties. In this embodiment, the insole 41 can comprise or be formed from, for example, ethylvinylacetate (EVA). If desired, the shoe bottom 2 can include one or more other subcomponents such as gas, liquid, or fluid bladders encapsulated in the material of the shoe bottom, for providing additional cushioning to a user.

The present system for attaching a shoe upper 1 to a shoe bottom 2 allows the wearer of the shoe to easily remove and attach the upper and the bottom on a regular basis. One advantage of having a removable upper is to allow the replacement of the upper with an alternative upper, for example one with an alternative pattern or color. In addition to allowing uppers of different patterns or colors to be attached to the same bottom portion of an article of footwear, the present attachment system can be used to attach a bottom to uppers having different structural features. For example, as shown in FIG. 5, a 3-point sandal strap can also be used in place of the uppers shown in FIGS. 1 and 4.

The use of a removable upper can also allow the uppers of a pair of shoes to be reversed, such as by attaching the left upper to the right bottom, and the right upper to the left bottom. In this embodiment, a right-side upper is removed from the right-side bottom portion, turned over so that the underside faces upward with respect to the bottom portion, and then reattached to the left-side bottom portion. The left-side upper is attached to the right-side bottom portion in a similar manner.

As used herein, the term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Although the present invention has been discussed in considerable detail with reference to certain preferred embodiments, other embodiments are possible. The steps disclosed for the present methods are not intended to be limiting nor are they intended to indicate that each step depicted is essential to the method, but instead are exemplary steps only. Therefore, the scope of the appended claims should not be limited to the description of preferred embodiments contained in this disclosure. All references cited herein are incorporated by reference in their entirety.

What is claimed is:

1. An article of footwear, comprising:

(a) a removable shoe upper, the upper comprising a front portion and a perimeter edge in a lower portion of the shoe upper;

(b) a shoe bottom having an upper surface, a lower surface, and a sidewall between the upper surface and the lower surface, the shoe bottom comprising:

sidewall channels in the sidewall of the shoe bottom, each sidewall channel comprising a rear surface in the sidewall;

lower surface channels in the lower surface of the shoe bottom, the lower surface channels extending inwardly from the sidewall;

a plurality of lugs on the lower surface of the shoe bottom, wherein each lug has a rear surface positioned inwardly with respect to the rear surface of at least one of the sidewall channels; wherein each lower surface channel extends to the rear surface of a respective lug; and (c) a plurality of elastic loop fasteners for attaching the shoe upper to the shoe bottom, each elastic loop fastener being attached to the perimeter edge of the shoe upper in a spaced-apart manner for placement into at least one of the sidewall channels in the sidewall of the shoe bottom, wherein each of the elastic loop fasteners is threaded through corresponding sidewall and lower surface channels and engages the rear surface of one of the lugs, thereby resulting in a tensioned engagement of the sidewall channels, lower surface channels, and lugs by the elastic loop fasteners when the shoe upper is attached to the shoe bottom.

2. The article of footwear of claim 1, wherein the sidewall channels connect to the lower surface channels.

3. The article of footwear of claim 2, wherein the sidewall channels and lower surface channels are deeper than a diameter of each of the elastic loop fasteners, such than an outer surface of each elastic loop fastener does not protrude beyond the surfaces of the sidewall channels and the lower surface channels when the elastic loop fasteners are placed in the sidewall channels and lower surface channels.

4. The article of footwear of claim 1, wherein the shoe upper comprises a flat sheet of flexible material.

5. The article of footwear of claim 4, wherein the shoe upper comprises two slits, one slit being in a medial side of the shoe upper and the other slit being in an opposite lateral side of the shoe upper and wherein an elongated opening is positioned between the two slits, thereby allowing a rearward area of the shoe upper to curve at a different angle than a frontward area when the shoe upper is attached to the shoe bottom.

6. The article of footwear of claim 4, wherein the front portion of the shoe upper comprises multiple, spaced-apart tabs.

7. The article of footwear of claim 1, wherein the shoe bottom comprises an insole and an outsole, and wherein the sidewall channels are formed in the outsole.

8. The article of footwear of claim 7, wherein the outsole comprises a cavity for retaining the insole.

9. The article of footwear of claim 8, wherein an upper portion of the outsole comprises a lip for mechanically retaining the insole in the cavity.

10. The article of footwear of claim 1, wherein the shoe upper comprises a three point sandal strap having a toe-post, and wherein the shoe bottom comprises a hole extending from the upper surface of the shoe bottom to the lower surface of the shoe bottom that allows the sandal post to pass therethrough.

11. The article of footwear of claim 1, wherein each elastic loop fastener is placed into two different sidewall channels.

12. The article of footwear of claim 1, wherein the lugs form a tread pattern in the lower surface of the shoe bottom.

13. The article of footwear of claim 1, wherein the shoe bottom has a recessed channel around a perimeter of the upper surface of the shoe bottom adjacent the sidewall, the recessed channel being sized to allow the perimeter edge of the shoe upper to be inserted into it.

14. A method of attaching a shoe upper to a shoe bottom, comprising the steps of:

(a) providing the article of footwear of claim 1;

(b) positioning the perimeter edge of the shoe upper on the upper surface of the shoe bottom, each elastic loop fastener being vertically aligned with at least one sidewall channel;

(c) fitting an elastic loop fastener into a respective sidewall channel with which it is aligned;

(d) pulling a middle portion of the elastic loop fastener downward past the lower vertical extent of the respective sidewall channel;

(e) pulling the middle portion of the elastic loop fastener past a rear surface of a lug positioned inwardly with respect to the respective sidewall channel, thereby stretching the elastic loop fastener; and (f) releasing the elastic loop fastener, wherein the elastic loop fastener elastically contracts after being released and contacts the rear surface of the lug, thereby securing the shoe upper to the shoe bottom.

* * * * *